US010741901B2

(12) United States Patent
Chang et al.

(10) Patent No.: US 10,741,901 B2
(45) Date of Patent: Aug. 11, 2020

(54) LOW-PROFILE STACKED PATCH RADIATOR WITH INTEGRATED HEATING CIRCUIT

(71) Applicant: Raytheon Company, Waltham, MA (US)

(72) Inventors: Yueh-Chi Chang, Northborough, MA (US); Brandon K.W. Mui, Chelmsford, MA (US); Stephen J. Pereira, Hopedale, MA (US); Richard S. Young, Ludlow, MA (US); Gregory M. Fagerlund, Peabody, MA (US); Wayne B. Mattis, Townsend, MA (US)

(73) Assignee: Raytheon Company, Waltham, MA (US)

( * ) Notice: Subject to any disclaimer, the term of this patent is extended or adjusted under 35 U.S.C. 154(b) by 382 days.

(21) Appl. No.: 15/786,474

(22) Filed: Oct. 17, 2017

(65) Prior Publication Data

US 2019/0115645 A1 Apr. 18, 2019

(51) Int. Cl.
*H01Q 1/02* (2006.01)
*H01Q 21/06* (2006.01)
(Continued)

(52) U.S. Cl.
CPC ..... *H01Q 1/02* (2013.01); *H01Q 1/38* (2013.01); *H01Q 1/523* (2013.01); *H01Q 3/38* (2013.01);
(Continued)

(58) Field of Classification Search
CPC .... H01Q 1/02; H01Q 9/0414; H01Q 21/0075; H01Q 21/065; H01Q 1/3266; H01Q 1/3275; H01Q 1/1278
See application file for complete search history.

(56) References Cited

U.S. PATENT DOCUMENTS 5,283,715 A 2/1994 Carlsten et al.
6,624,787 B2 9/2003 Puzella et al.
(Continued)

OTHER PUBLICATIONS

Bugaj et al., "Chapter 2: Bandwidth Optimization of Aperture-Coupled Stacked Patch Antenna", published in "Advancement in Microstrip Antennas with Recent Applications", Intech, Mar. 2013, 24 pages.

*Primary Examiner* — Dameon E Levi
*Assistant Examiner* — David E Lotter

(57) ABSTRACT

An apparatus includes a stacked patch radiator having (i) a lower patch and (ii) an upper patch located above and separated from the lower patch. The upper patch includes first and second conductive patches that are separated from one another. The apparatus also includes a heating circuit integrated in the stacked patch radiator. At least a portion of the heating circuit is positioned between the first and second conductive patches of the upper patch. The stacked patch radiator can be configured to radiate at a specified frequency band and can have a thickness that is less than one tenth of wavelengths within the specified frequency band. The upper patch can include conductive vias electrically connecting the conductive patches. The conductive patches and the conductive vias can form an isolation cage configured to reduce a signal loss associated with a presence of at least the portion of the heating circuit between the conductive patches.

22 Claims, 7 Drawing Sheets

(51) Int. Cl.

| | |
|---|---|
| ***H01Q 9/04*** | (2006.01) |
| ***H01Q 1/52*** | (2006.01) |
| ***H01Q 1/38*** | (2006.01) |
| ***H01Q 3/38*** | (2006.01) |
| *H01Q 21/00* | (2006.01) |

(52) U.S. Cl.
CPC ..... *H01Q 9/0414* (2013.01); *H01Q 9/0457* (2013.01); *H01Q 21/065* (2013.01); *H01Q 21/0075* (2013.01)

(56) References Cited

U.S. PATENT DOCUMENTS

| | | | | |
|---|---|---|---|---|
| 7,099,686 | B2 | 8/2006 | Ro et al. | |
| 7,525,498 | B2 | 4/2009 | Quan et al. | |
| 7,898,365 | B2 | 3/2011 | Koehnke et al. | |
| 7,940,524 | B2 | 5/2011 | Rummel et al. | |
| 8,026,863 | B2 | 9/2011 | Young et al. | |
| 8,339,790 | B2 | 12/2012 | Reza et al. | |
| 8,717,243 | B2 | 5/2014 | Yaccarino et al. | |
| 2003/0067410 | A1* | 4/2003 | Puzella ..... | 343/700 MS |

* cited by examiner

LOW-PROFILE STACKED PATCH RADIATOR WITH INTEGRATED HEATING CIRCUIT

GOVERNMENT RIGHTS

This invention was made with U.S. government support under contract number W31P4Q-15-C-0022 awarded by the U.S. Army. The U.S. government may have certain rights in this invention.

TECHNICAL FIELD

This disclosure generally relates to antenna systems.

BACKGROUND

Antenna systems are used in a wide variety of applications, such as to search for and track aircraft or other objects in the sky or to identify "friends" or "foes." Antenna systems often need to include heating circuits in order to prevent ice from forming on outer portions of the antennas (referred to as "anti-icing") or to remove ice that has already formed on the outer portions of the antennas (referred to as "de-icing").

Various approaches have been developed for integrating heating circuits into antenna systems. In one conventional approach, slot radiators are used in an antenna system, and multiple heating pads are embedded within the metallic cover that is part of the slot radiators. Unfortunately, such slot radiators inherently do not provide wide scan capability, which can potentially affect the operation of the antenna system. In another conventional approach, a cavity-backed stacked patch radiator is used in an antenna system, and heat can be conducted to a front surface of the radiator. However, the stacked patch radiator does not have a low profile that some antenna systems need for certain applications.

SUMMARY

This disclosure provides a low-profile stacked patch radiator with an integrated heating circuit.

In a first embodiment, an apparatus includes a stacked patch radiator having (i) a lower patch and (ii) an upper patch located above and separated from the lower patch. The upper patch includes first and second conductive patches that are separated from one another. The apparatus also includes a heating circuit integrated in the stacked patch radiator. At least a portion of the heating circuit is positioned between the first and second conductive patches of the upper patch.

In a second embodiment, a system includes an antenna array having multiple stacked patch radiators and one or more heating circuits. Each stacked patch radiator includes (i) a lower patch and (ii) an upper patch located above and separated from the lower patch. The upper patch includes first and second conductive patches that are separated from one another. At least a portion of the one or more heating circuits is positioned between the first and second conductive patches of the upper patches in the stacked patch radiators.

In a third embodiment, a method includes forming a stacked patch radiator having (i) a lower patch and (ii) an upper patch located above and separated from the lower patch. The upper patch includes first and second conductive patches that are separated from one another. The method also includes, during formation of the stacked patch radiator, integrating a heating circuit in the stacked patch radiator. At least a portion of the heating circuit is positioned between the first and second conductive patches of the upper patch.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 7, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

As noted above, various approaches have been developed that allow the integration of heating circuits into antenna systems. However, each of these approaches typically suffers from one or more shortcomings, such as lower scan angles or larger physical or electrical profiles. Embodiments described in this patent document include various low-profile stacked patch radiators with integrated heating circuits. The low profiles of the stacked patch radiators enable the stacked patch radiators to have electrically "thin" radiator designs that are capable of scanning to very wide angles with good bandwidth. Moreover, the integration of the heating circuits enables the stacked patch radiators to support de-icing and anti-icing capabilities. These types of radiator designs can be used in a number of applications, such as low-profile phased-array systems or other systems that require or desire high radio frequency (RF) performance while being exposed to outdoor elements. These types of radiator designs can be manufactured at reasonable costs, such as by using conventional printed circuit fabrication processes or other conventional processes.

Figure 1:
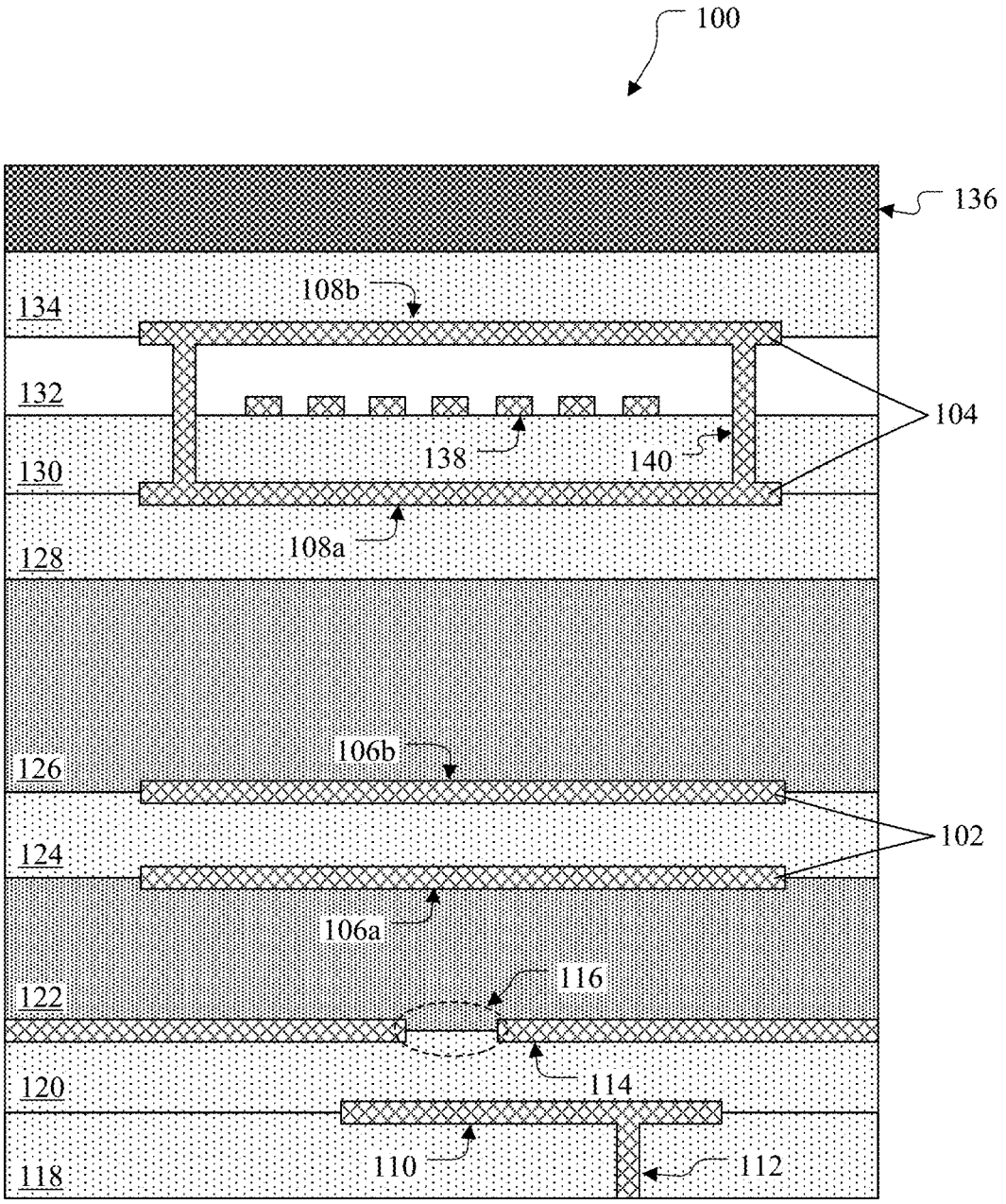
FIG. 1 illustrates a cross-sectional view of an example low-profile stacked patch radiator with an integrated heating circuit according to this disclosure.

FIG. 1 illustrates a cross-sectional view of an example low-profile stacked patch radiator 100 with an integrated heating circuit according to this disclosure. As shown in FIG. 1, the stacked patch radiator 100 includes a lower patch 102 and an upper patch 104. The upper patch 104 is located above the lower patch 102, giving the radiator 100 a "stacked patch" design. The lower and upper patches 102 and 104 operate to radiate RF signals or other signals from the stacked patch radiator 100.

In this example, the lower patch 102 includes one or more conductive patches 106*a*-106*b*, and the upper patch 104 includes two conductive patches 108*a*-108*b*. The conductive patches 106*a*-106*b* can be generally parallel to each other, the conductive patches 108*a*-108*b* can be generally parallel to each other, and the conductive patches 106*a*-106*b* can be generally parallel to the conductive patches 108*a*-108*b*. Each of the conductive patches 106*a*-106*b* and 108*a*-108*b* can be formed from any suitable conductive material(s). For example, each of the conductive patches 106*a*-106*b* and 108*a*-108*b* can be formed using one or more metals or metal alloys, such as copper. For instance, one or more metals or other conductive materials can be printed or otherwise deposited on a substrate or other structure and then etched (if necessary) to form a conductive patch.

The lower and upper patches 102 and 104 in this example are provided RF signals using a feed stripline 110. Energy from incoming signals is coupled from a signal source into the lower patch 102 by the feed stripline 110. The feed stripline 110 can include any suitable conductive structure that is configured to receive a signal and couple signal energy to the lower patch 106. In this example, the feed stripline 110 can be fed by a conductive probe 112 of a coaxial line, although the feed stripline 110 can be fed in other ways.

Each of the feed stripline 110 and the conductive probe 112 can be formed from any suitable conductive material(s), such as one or more metals or metal alloys. For instance, one or more metals or other conductive materials can be printed or otherwise deposited on a substrate or other structure and then etched (if necessary) to form the feed stripline 110. Each conductive probe 112 can represent a center conductor of a coaxial connector or other connector, which can be connected to a feed stripline 110 via soldering.

The lower and upper patches 102 and 104 are fed by the feed stripline 110 through a ground plane 114 having a slot 116. The ground plane 114 includes any suitable conductive structure that can be coupled to an electrical ground. The slot 116 includes an opening in the ground plane 114 that allows energy in the signals received by the feed stripline 110 to couple into the lower and upper patches 102 and 104.

The ground plane 114 can be formed from any suitable conductive material(s), such as one or more metals or metal alloys. For instance, one or more metals or other conductive materials can be printed or otherwise deposited on a substrate or other structure and then etched (if necessary) to form the ground plane 114 with the slot(s) 116. Each slot 116 can have any suitable size and shape, such as a rectangular shape.

The stacked patch radiator 100 also includes various layers 118-136 of materials on or in which various structures can be formed or that separate various structures. In this example, the layers 118 and 120 include substrates that are electrically insulative but clayed with copper or other conductive materials (where the conductive materials form the feed stripline 110 and the ground plane 114). In some embodiments, the layers 118 and 120 include microwave printed circuit board (PCB) laminates, such as, for example, DUROID 6002 high frequency laminates from ROGERS CORPORATION. Each of the layers 118 and 120 can have any suitable thickness, such as about 50 mils to about 70 mils (about 0.127 cm to about 0.1778 cm). In addition, the layers 118 and 120 can be attached to each other using an adhesive, such as, for example, 2929 BONDPLY from ROGERS CORPORATION at a thickness of about 3 mils to about 5 mils (about 0.00762 cm to about 0.0127 cm).

The layer 122 includes a layer of rigid foam separating the ground plane 114 and the lower patch 102. The layer 122 is used here to displace the lower patch 102 from the ground plane 114 while providing structural rigidity. The layer 122 can be formed from any suitable foam material that is rigid enough to ensure consistent separation of the lower patch 102 from the ground plane 114. For example, the layer 122 can be formed using ROHACELL 200WF-HT structural foam from EVONIK INDUSTRIES AG. The layer 122 can also have any suitable thickness, such as about 170 mils to about 210 mils (about 0.4318 cm to about 0.5334 cm). In addition, the layer 122 can be attached to adjacent layers, such as, for example, by using an adhesive. In some embodiments, the layer 122 can be attached to adjacent layers using CUCLAD 6250 bonding film from ROGERS CORPORATION at a thickness of about 3 mils to about 5 mils (about 0.00762 cm to about 0.0127 cm).

The layer 124 includes a substrate that helps to separate the conductive patches 106*a*-106*b* of the lower patch 102. In some embodiments, the layer 124 includes a microwave PCB laminate, such as an RO4003 ceramic laminate from ROGERS CORPORATION. The layer 124 can also have any suitable thickness, such as about 50 mils to about 70 mils (about 0.127 cm to about 0.1778 cm). In addition, the layer 124 can be attached to other layers, such as, for example, by using an adhesive.

The layer 126 includes a layer of rigid foam separating the lower patch 102 and the upper patch 104. The layer 126 is used here to displace the upper patch 104 from the lower patch 102 while providing structural rigidity. The layer 126 can be formed from any suitable foam material that is rigid enough to ensure consistent separation of the patches 102 and 104. For example, the layer 126 can be formed using ROHACELL 200WF-HT structural foam. The layer 126 can also have any suitable thickness, such as about 360 mils to about 440 mils (about 0.9144 cm to about 1.1176 cm). In addition, the layer 126 can be attached to adjacent layers, such as, for example, by using an adhesive. In some embodiments, the layer 126 can be attached to adjacent layers using CUCLAD 6250 bonding film at a thickness of about 3 mils to about 5 mils (about 0.00762 cm to about 0.0127 cm).

The layers 128, 130, and 134 include substrates that help to separate the conductive patches 108*a*-108*b* of the upper patch 104 from each other and surrounding structures. In some embodiments, each of the layers 128, 130, and 134 is formed from a microwave PCB laminate, such as an RO4003C ceramic laminate from ROGERS CORPORATION. Each of the layers 128, 130, and 134 can also have any suitable thickness. For example, the layers 128 and 134 can each have a thickness of about 18 mils to about 22 mils (about 0.04572 cm to about 0.05588 cm), and the layer 130 can have a thickness of about 6 mils to about 10 mils (about 0.01524 cm to about 0.0254 cm).

The layer 132 includes a layer of dielectric material, such as a flexible dielectric film. Any suitable dielectric material or materials can be used here, such as a dielectric having a high thermal conductivity. In some embodiments, the layer 132 can be formed using polyimide. The layers 128-134 in FIG. 1 can also be attached to each other or other layers, such as, for example, by using an adhesive. For example, the layers 128-130 can be attached to each other, the layers 130-132 can be attached to each other, and the layers 132-134 can be attached to each other using an FM300 film adhesive from CYTEC ENGINEERED MATERIALS at a thickness of about 4 mils to about 6 mils (about 0.01016 cm to about 0.01524 cm).

The layer 136 includes one or more materials used for environmental protection, meaning the layer 136 helps to protect the underlying layers from damage caused by the surrounding environment in which the stacked patch radiator 100 is used. In some embodiments, the layer 136 can include a layer of protective paint or other protective coating(s) or material(s). The layer 136 can also have any suitable thickness, such as a thickness of about 4 mils to about 6 mils (about 0.01016 cm to about 0.01524 cm).

The stacked patch radiator 100 further includes at least one heating circuit 138, which is located between the conductive patches 108*a*-108*b* of the upper patch 104. Each heating circuit 138 includes at least one conductive structure that generates heat for de-icing, anti-icing, or other purposes. The heating circuit 138 can, for example, include one or more conductive traces within the space between the conductive patches 108*a*-108*b* of the upper patch 104. One or more electrical currents can be passed through the conductive trace(s), and the resistance of the conductive trace(s) can generate heat. In some embodiments, the heating circuit 138 can be used to distribute heating power fairly uniformly over at least part of an aperture of the stacked patch radiator 100 in order to provide de-icing and anti-icing capabilities. The aperture of the stacked patch radiator 100 represents the area above the upper patch 104 through which RF energy is radiated into free space.

The heating circuit 138 can be formed using one or more metals or other conductive materials, such as a nickel-chromium alloy (often referred to as a Nichrome). For instance, one or more metals or other conductive materials can be printed or otherwise deposited on a substrate or other structure and then etched (if necessary) to form the heating circuit 138. In particular embodiments, the heating circuit 138 can be formed by depositing a Nichrome in or on an FR404 epoxy laminate from ISOLA LAMINATE SYSTEMS CORPORATION. The heating circuit 138 can have any suitable thickness, such as about 0.5 mil to about 1.0 mil (about 0.00127 cm to about 0.00254 cm).

Because the heating circuit 138 is located between the conductive patches 108*a*-108*b* of the upper patch 104, the heating circuit 138 can potentially attenuate some of the RF energy being radiated by the stacked patch radiator 100. This can cause Ohmic losses or other signal losses in the stacked patch radiator 100. In order to minimize the RF signal loss in the stacked patch radiator 100, the dielectric layer 132 is used above the heating circuit 138, and various conductive vias 140 are used to electrically shield the heating circuit 138 from the RF signal. The conductive vias 140 include conductive structures that link the conductive patches 108*a*-108*b*. In some embodiments, the conductive vias 140 can be located along the E-plane edges of the upper patch 104.

The conductive patches 108*a*-108*b* and the conductive vias 140 effectively form an isolation "cage" around the heating circuit 138, which helps to reduce or minimize losses associated with the presence of the heating circuit 138 within the upper patch 104. Note that all or substantially all of the stacked patch radiator 100 in FIG. 1 can also be enclosed by a metallic or other conductive cavity, which can help to enhance scan performance and prevent formation of surface waves while scanning. For example, the conductive vias 140 can be formed as plated thru-holes in which openings are formed through the layers 130 and 132 and one or more metals or other conductive materials are deposited into the openings.

The stacked patch radiator 100 shown in FIG. 1 has a very low profile compared to many conventional stacked patch radiators. In some embodiments, the stacked patch radiator 100 has a total thickness that is less than one tenth of a wavelength radiated by the stacked patch radiator 100 into free space. In particular embodiments, the stacked patch radiator 100 has a total thickness that is less than or equal to 0.09 times the wavelength radiated by the stacked patch radiator 100 into free space. This can be achieved through the use of the slot-coupled stacked patch design and the use of the rigid foam layers 122 and 126 separating components of the stacked patch radiator 100. The various thicknesses of the layers 118-136 can also be reduced or minimized, such as by using standard or custom algorithm optimizations. This allows the stacked patch radiator 100 to be used in applications that desire or require a low profile, such as when antennas (including phase shifter, beamformer, and antenna housing) are desired or required to have a total thickness of less than 0.35 times the wavelength.

Moreover, because the stacked patch radiator 100 shown in FIG. 1 includes an integrated heating circuit 138, the stacked patch radiator 100 can achieve very good de-icing and anti-icing performance when in use. Further, Ohmic or other signal losses associated with the presence of the integrated heating circuit 138 in the stacked patch radiator 100 can be reduced or minimized as described above. Beyond that, even with its low profile, the stacked patch radiator 100 is capable of scanning to extremely wide angles while achieving good bandwidth. In addition, the stacked patch radiator 100 does not require time-consuming manual tuning and trimming. The stacked patch radiator 100 in its entirety can be fabricated at a printed wiring board (PWB) and circuit card assembly (CCA) house, and the stacked patch radiator 100 can be tested to ensure compliance with applicable requirements and then delivered for use in a variety of array or other configurations.

The stacked patch radiator 100 shown in FIG. 1 can be used in a number of different applications. For example, multiple instances of the stacked patch radiator 100 can be used in a phased-array antenna system or other low-profile antenna array. As a particular example, the stacked patch radiator 100 can be used as part of an Identification Friend or Foe (IFF) system, such as an IFF system that operates in the L-band between 1.03 GHz and 1.09 GHz.

Although FIG. 1 illustrates a cross-sectional view of one example of a low-profile stacked patch radiator 100 with an integrated heating circuit 138, various changes may be made to the design of FIG. 1. For example, the relative sizes, shapes, and dimensions of the components shown in FIG. 1 are for illustration only. Various components in FIG. 1 can be resized as needed or desired. Also, various layers of materials in FIG. 1 can be combined, further subdivided, rearranged, or omitted and additional layers can be added according to particular needs.

Figure 2:
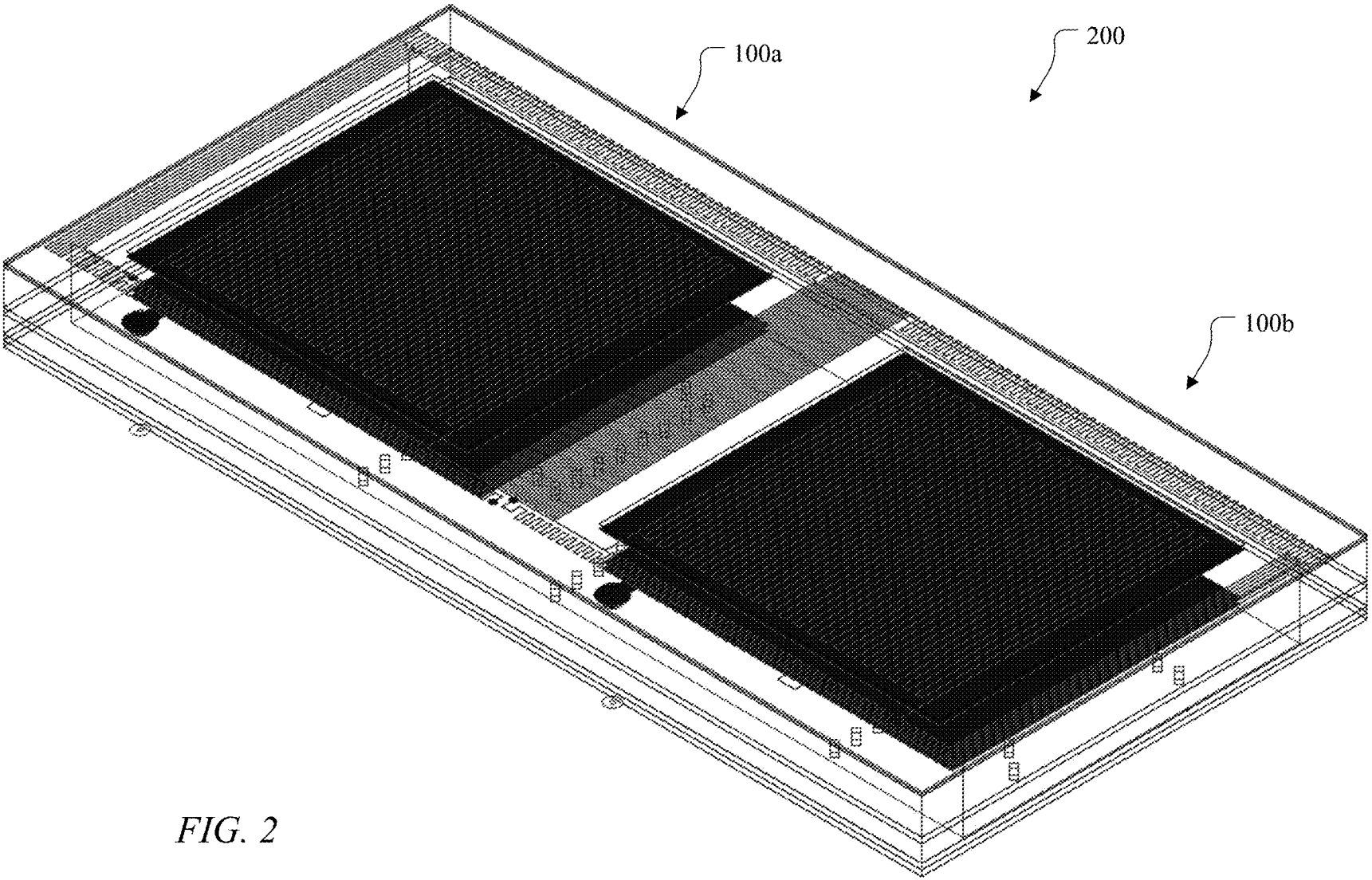
FIG. 2 illustrates an isometric view of an example system having low-profile stacked patch radiators with integrated heating circuits according to this disclosure.
Figure 3:
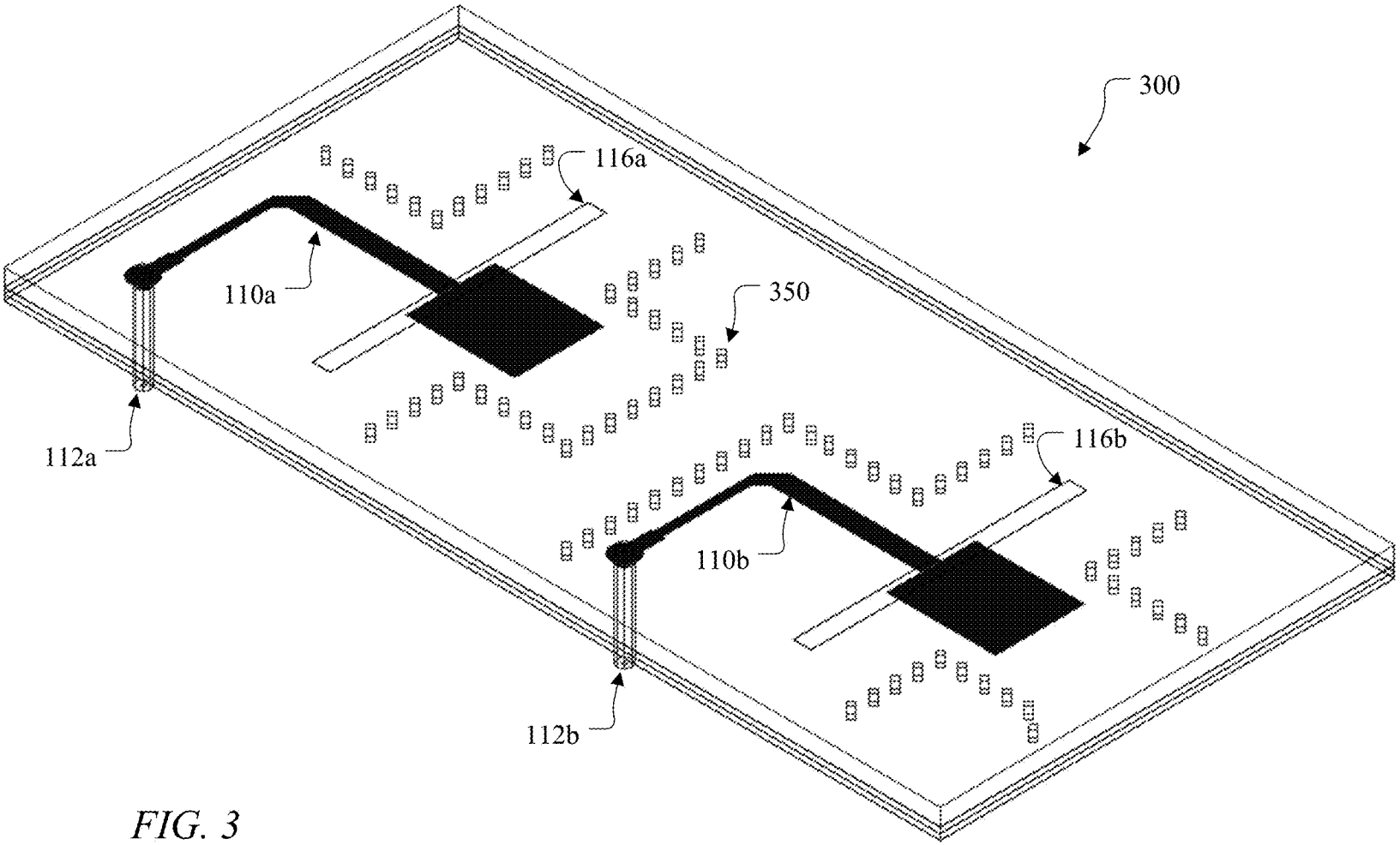
FIGS. 3 through 5 illustrate example layers of a system having low-profile stacked patch radiators with integrated heating circuits according to this disclosure.
Figure 4:
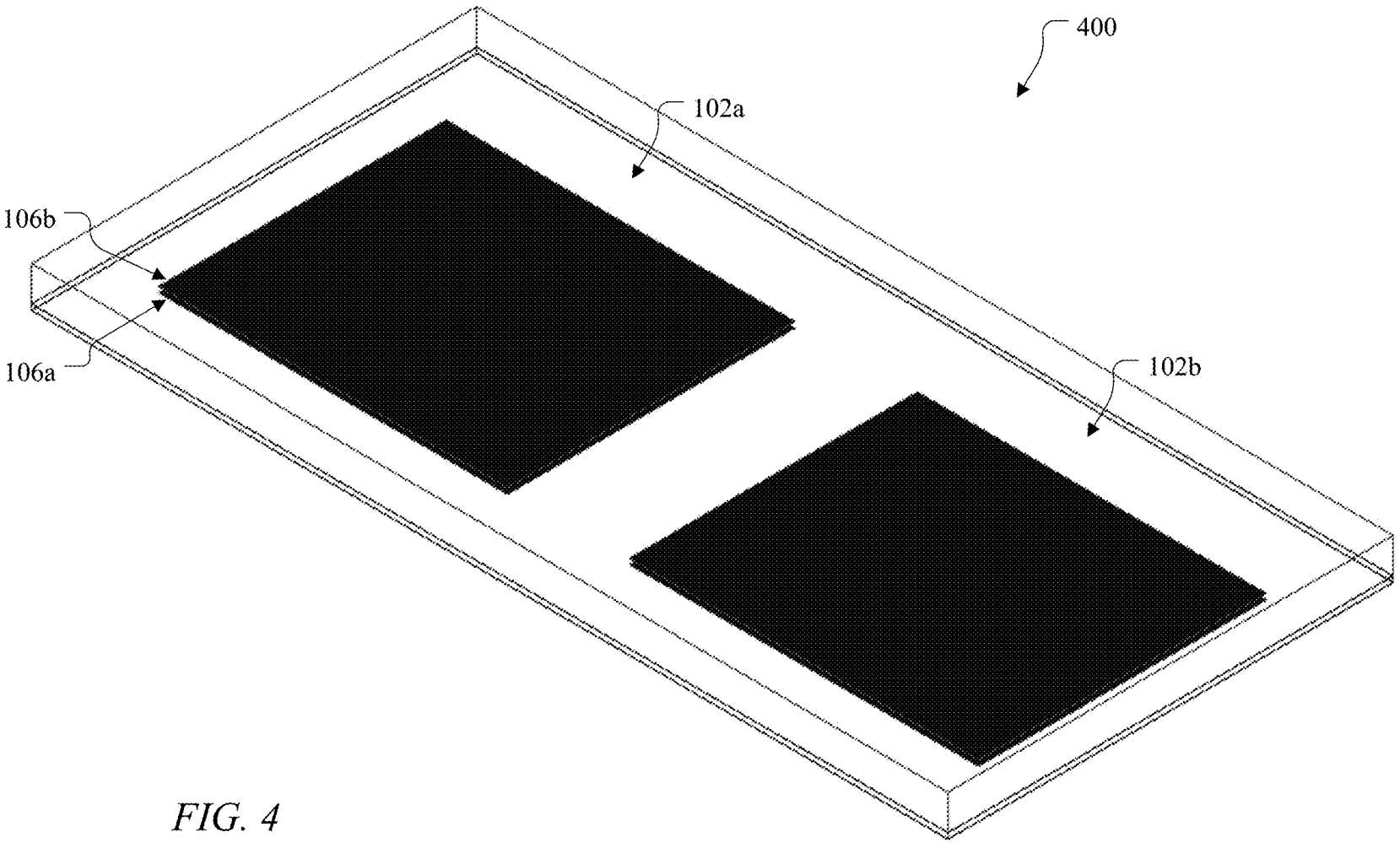
Figure 5:
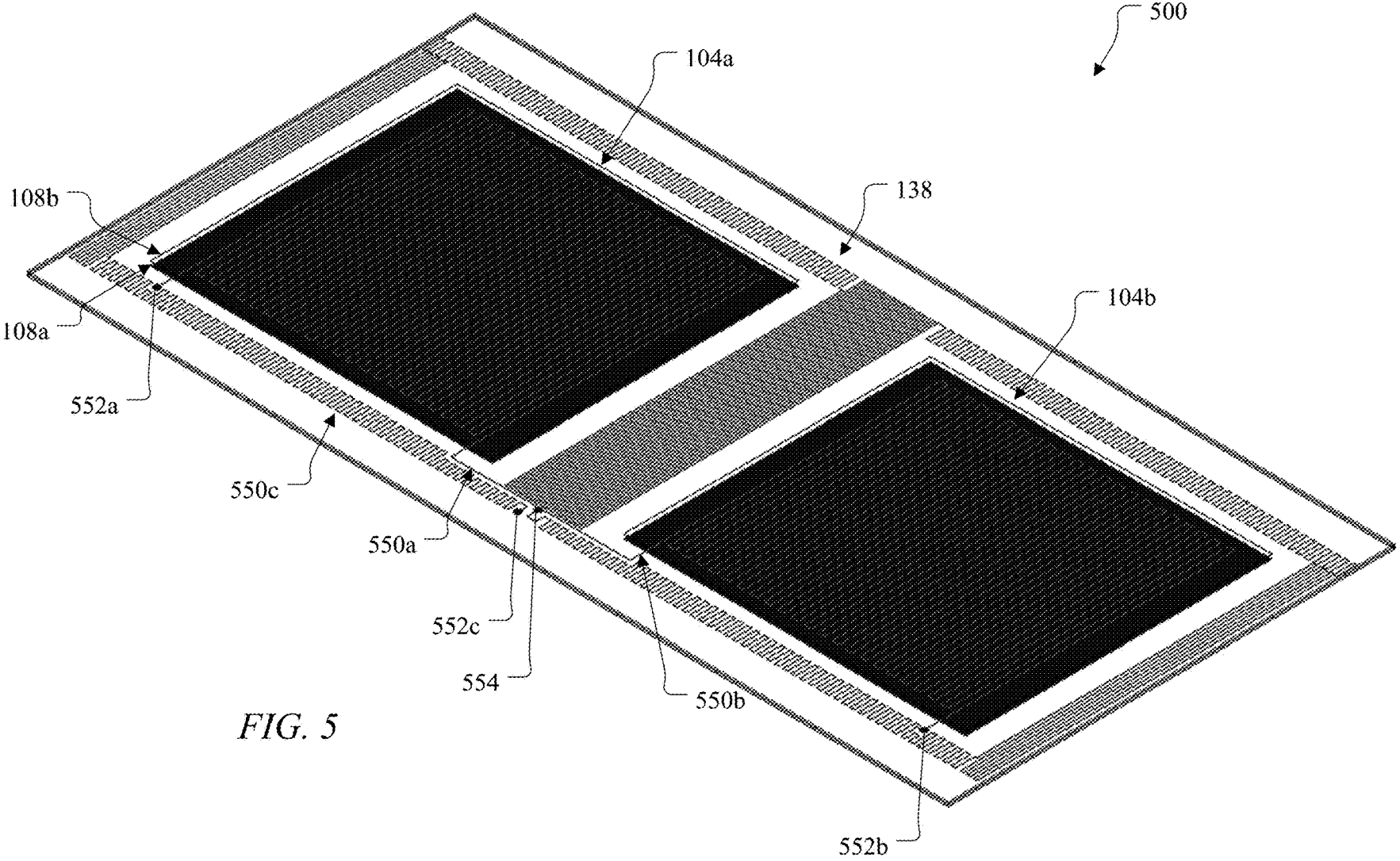

FIG. 2 illustrates an isometric view of an example system 200 having low-profile stacked patch radiators with integrated heating circuits according to this disclosure. FIGS. 3 through 5 illustrate example layers of the system 200 having low-profile stacked patch radiators with integrated heating circuits according to this disclosure. As shown in FIG. 2, the system 200 in this example includes two low-profile stacked patch radiators 100*a*-100*b*. Each of the stacked patch radiators 100*a*-100*b* can be designed as described above with respect to FIG. 1. Note, however, that the system 200 can include any number of low-profile stacked patch radiators in any suitable configuration.

As shown in FIG. 3, lower layers 300 of the stacked patch radiators 100*a*-100*b* include feed striplines 110*a*-110*b*, which are coupled to conductive probes 112*a*-112*b*, respectively. The conductive probes 112*a*-112*b* receive signal energy and provide the signal energy to the feed striplines 110*a*-110*b*. In some embodiments, the conductive probes 112*a*-112*b* can be coupled to a 1:2 divider board or other structure that receives and divides a single signal, which allows the stacked patch radiators 100*a*-100*b* to be fed using a single signal.

The lower layers 300 of the stacked patch radiators 100*a*-100*b* also include multiple slots 116*a*-116*b*, which are used to couple the signal energy from the feed striplines 110*a*-110*b* to other layers of the stacked patch radiators 100*a*-100*b*. The lower layers 300 of the stacked patch radiators 100*a*-100*b* further include conductive vias 350, which can include plated thru-holes or other conductive structures. The conductive vias 350 can be formed through the lower layers 300 in order to help provide electrical isolation of the feed striplines 110*a*-110*b* from one another.

As shown in FIG. 4, intermediate layers 400 of the stacked patch radiators 100*a*-100*b* include lower patches 102*a*-102*b*. Each of the lower patches 102*a*-102*b* is formed using two conductive patches 106*a*-106*b* that are separated from one another. Each of the lower patches 102*a*-102*b* receives the signal energy from the corresponding feed stripline 110*a*-110*b* through the corresponding slot 116*a*-116*b*.

As shown in FIG. 5, upper layers 500 of the stacked patch radiators 100*a*-100*b* include upper patches 104*a*-104*b*. Each of the upper patches 104*a*-104*b* is formed using two conductive patches 108*a*-108*b* that are separated from one another. Each of the upper patches 104*a*-104*b* receives the signal energy from the corresponding lower patch 102*a*-102*b*.

The upper layers 500 of the stacked patch radiators 100*a*-100*b* also include at least one heating circuit 138, at least part of which is positioned between the conductive patches 108*a*-108*b* of the upper patches 104*a*-104*b*. The conductive patch 108*b* in each upper patches 104*a*-104*b* is shown in outline form here so that the path of the heating circuit 138 can be seen.

In the specific example shown in FIG. 5, the heating circuit 138 is formed using a number of conductive traces 550*a*-550*c*, which can include Nichrome or other resistive heating elements. In this example, the conductive trace 550*a* primarily zig-zags or travels back and forth across an aperture associated with the stacked patch radiator 100*a*, and the conductive trace 550*b* primarily zig-zags or travels back and forth across an aperture associated with the stacked patch radiator 100*b*. The conductive trace 550*c* primarily zig-zags or travels back and forth around the outer edges of the apertures associated with the stacked patch radiators 100*a*-100*b* and between the apertures associated with the stacked patch radiators 100*a*-100*b*.

Electrical currents through the conductive traces 550*a*-550*c* can be created by coupling at least one power source to various terminals 552*a*-552*c* and 554 of the conductive traces 550*a*-550*c*. In this example, each of the terminals 552*a*-552*c* is coupled to a corresponding one of the conductive traces 550*a*-550*c*, and the terminal 554 is coupled to all of the conductive traces 550*a*-550*c*. The terminal 554 can represent a common ground, and the terminals 552*a*-552*c* can be coupled to a three-phase alternating current (AC) power source. Note, however, that this is not required and that any other suitable power source or sources can be used to create one or more currents in the heating circuit 138. Also note that other or additional conductive traces can be used to form the heating circuit 138.

As can be seen in FIG. 5, the conductive traces 550*a*-550*b* are primarily located between the conductive patches 108*a*-108*b* of the upper patches 104*a*-104*b*. The conductive patches 108*a*-108*b* of each upper patch 104*a*-104*b* can therefore be coupled together (such as by using the conductive vias 140) to form "cages" around the conductive traces 550*a*-550*b*. This allows the conductive traces 550*a*-550*b* to be used to heat the corresponding structures while intercepting little if any RF energy or other energy being transmitted. Moreover, the conductive traces 550*a*-550*b* can distribute heating power fairly uniformly over at least part of the radiating apertures of the stacked patch radiators 100*a*-100*b*, and the conductive traces 550*a*-550*c* can be designed to have and improved or optimal resistance to achieve efficient heat distribution. This helps to provide improved or optimal thermal performance with reduced or minimal impact on RF or other wireless performance.

The stacked patch radiators 100*a*-100*b* are able to achieve a wide bandwidth in order to cover a desired frequency band of interest while allowing for a large scan volume. The large scan volume can be important, for example, in the azimuth plane of the radiators 100*a*-100*b* and can be optimized for performance in that plane. Good return loss can be obtained even at a wide scan angle.

Although FIG. 2 illustrates an isometric view of one example of a system 200 having low-profile stacked patch radiators with integrated heating circuits and FIGS. 3 through 5 illustrate examples of layers of the system 200 having low-profile stacked patch radiators with integrated heating circuits, various changes may be made to the design of FIGS. 2 through 5. For example, the relative sizes, shapes, and dimensions of the components shown in FIGS. 2 through 5 are for illustration only. Various components in FIGS. 2 through 5 can be resized as needed or desired. Also, while two stacked patch radiators 100*a*-100*b* fed by a 1:2 divider and using a common heating circuit 138 are shown here, this need not be the case. For instance, each stacked patch radiator can be fed its own signal or include its own heating circuit. Moreover, more than two stacked patch radiators can be used.

Figure 6:
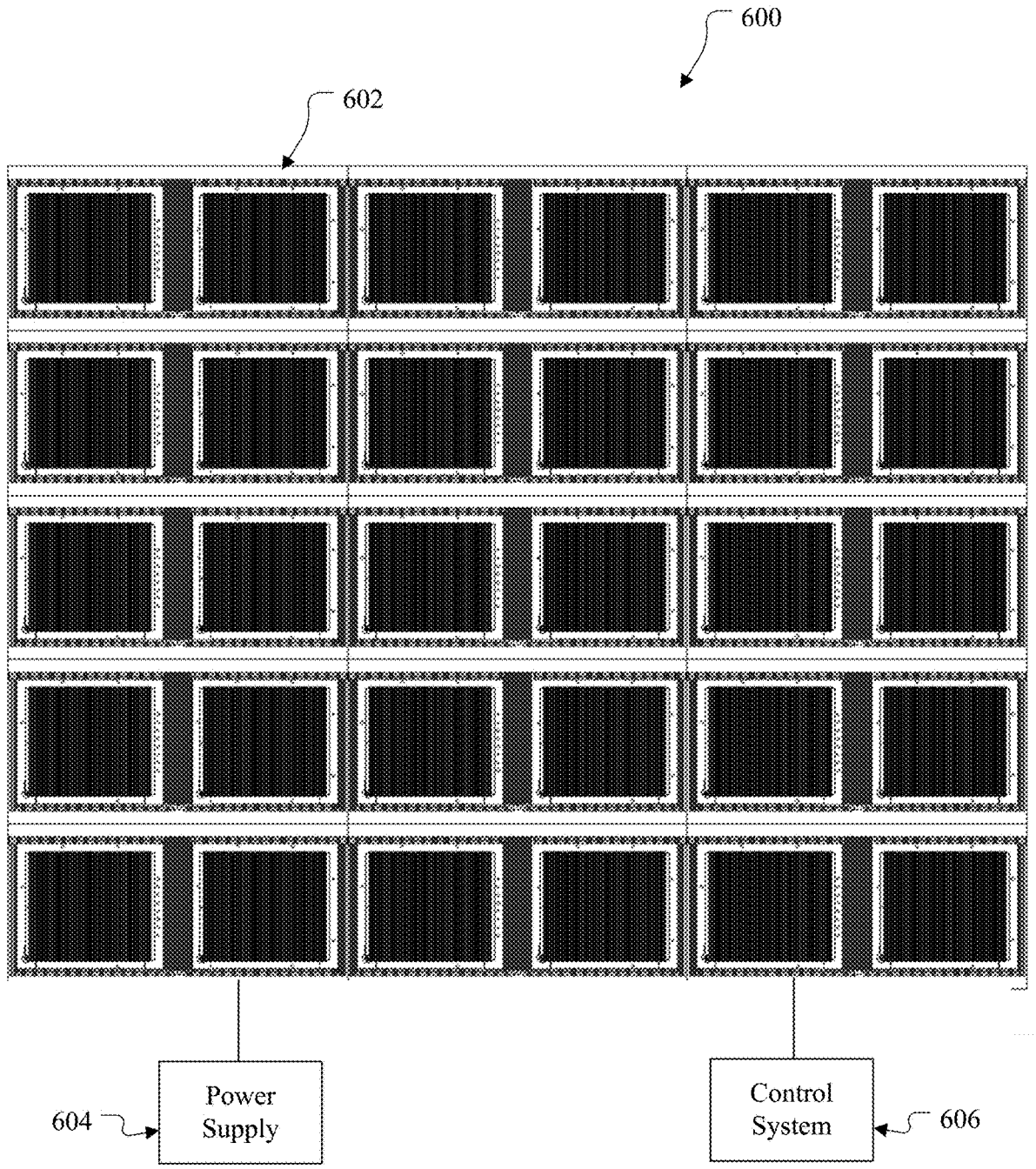
FIG. 6 illustrates an example antenna array containing low-profile stacked patch radiators with integrated heating circuits according to this disclosure.

FIG. 6 illustrates an example antenna array 600 containing low-profile stacked patch radiators with integrated heating circuits according to this disclosure. As shown in FIG. 6, the antenna array 600 includes multiple low-profile stacked patch radiators 602, each of which can represent the stacked patch radiator 100 of FIG. 1 or either of the stacked patch radiators 100*a*-100*b* of FIGS. 2 through 5. Each stacked patch radiator 602 can have its own integrated heating circuit (such as a heating circuit 138), or multiple stacked patch radiators 602 can share a common heating circuit (such as when pairs of radiators 602 share a heating circuit 138).

In this example, the antenna array 600 includes a five-by-five array of stacked patch radiators 602, although any other suitable numbers of stacked patch radiators 602 can be used. Also, while the stacked patch radiators 602 are shown here as being arranged in rows and columns, any other suitable arrangement of stacked patch radiators 602 can be used.

The antenna array 600 in this example includes or is used in conjunction with at least one power supply 604 and at least one control system 606. The power supply 604 can provide operational power to the control system 606, the stacked patch radiators 602, and other components of the antenna array 600. For example, the power supply 604 can provide electrical currents to the heating circuits 138 in the stacked patch radiators 602. Each power supply 604 includes any suitable source of operating power. In some embodiments, at least one three-phase AC power supply can be used with the heating circuits 138 in the stacked patch radiators 602.

The control system 606 includes one or more controllers that generally operate to control the operation of the antenna array 600. For example, the control system 606 can generate bit sequences for a phase shifter of each of the 25 radiator to steer the antenna beam to the desired direction. The control system 606 includes any suitable structure configured to control one or more aspects of the antenna array 600, such as a computing system.

Although FIG. 6 illustrates one example of an antenna array 600 containing low-profile stacked patch radiators with integrated heating circuits, various changes may be made to the design of FIG. 6. For example, the antenna system 600 shown in FIG. 6 has been simplified for ease of illustration and explanation. Phased-array antenna systems and other antenna systems routinely include a number of other components to support advanced functionality, but a description of those components is not required here for an understanding of this disclosure.

Figure 7:
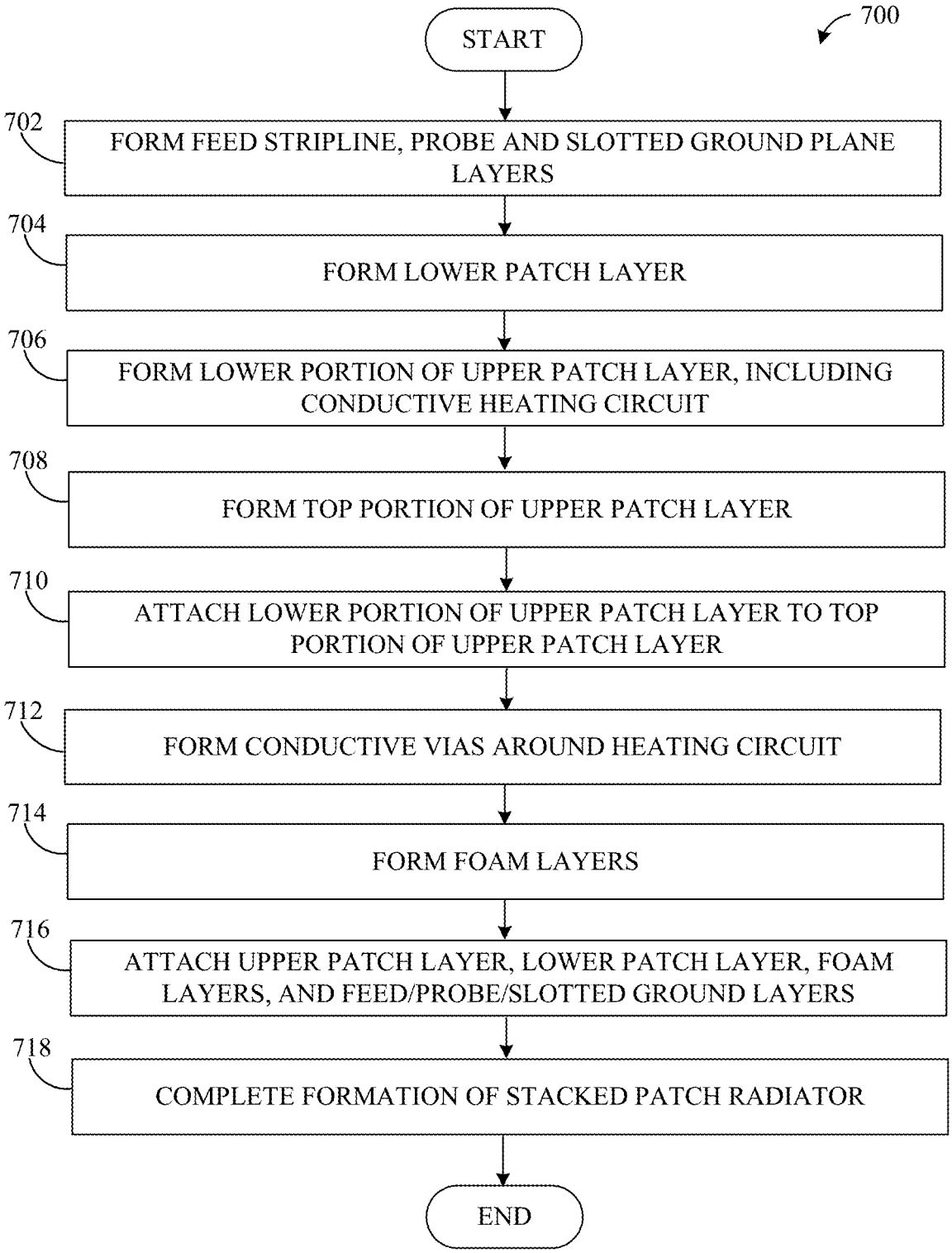
FIG. 7 illustrates an example method for forming a low-profile stacked patch radiator with an integrated heating circuit according to this disclosure.

FIG. 7 illustrates an example method 700 for forming a low-profile stacked patch radiator with an integrated heating circuit according to this disclosure. For ease of explanation, the method 700 is described with respect to the formation of the low-profile stacked patch radiator 100 shown in FIG. 1. However, the method 700 can be used to form any other suitable low-profile stacked patch radiators, including the stacked patch radiators 100*a*-100*b* of FIGS. 2 through 5.

As shown in FIG. 7, feed stripline, probe, and slotted ground plane layers are formed at step 702. This can include, for example, depositing one or more metals or other conductive materials on a microwave PCB laminate or other layer 118 to form the feed stripline 110. This can also include attaching a microwave PCB laminate or other layer 120 to the layer 118 and the feed stripline 110. This can further include depositing one or more metals or other conductive materials on the layer 120 to form the ground plane 114 with a slot 116. In addition, this can include drilling, etching, or otherwise forming an opening through the layer 118 and depositing one or more metals or other conductive materials in the opening to form the probe 112.

A lower patch layer is formed at step 704. This can include, for example, depositing one or more metals or other conductive materials on a microwave PCB laminate or other layer 124 to form the conductive patches 106*a*-106*b*. A lower portion of an upper patch layer, including a conductive heating circuit, is formed at step 706. This can include, for example, depositing one or more metals or other conductive materials on a microwave PCB laminate or other layer 128 to form the conductive patch 108*a*. This can also include attaching a microwave PCB laminate or other layer 130 to the conductive patch 108*a* and the layer 128. This can further include depositing one or more metals or other conductive materials on the layer 130 to form conductive traces of the heating circuit 138. A top portion of the upper patch layer is formed at step 708. This can include, for example, depositing one or more metals or other conductive materials on a microwave PCB laminate or other layer 134 to form the conductive patch 108*b*.

The lower and upper portions of the upper patch layer are attached to each other at step 710. This can include, for example, laminating the lower portion of the upper patch layer to the top portion of upper patch layer. This can also include forming a dielectric layer 132 over the heating circuit 138 and the layer 130 prior to the lamination. In particular embodiments, these layers 128-134 can be attached to each other using an FM300 film adhesive.

Conductive vias are formed at least partially around the heating circuit at step 712. This can include, for example, drilling, etching, or otherwise forming openings through the layers 130 and 132 to expose portions of the conductive patch 108*a*. This can also include depositing one or more metals or other conductive materials into the openings to form conductive vias 140. The conductive vias 140 are in electrical contact with the conductive patch 108*a*.

Multiple foam layers are formed at step 714. This can include, for example, machining a foam block or an off-the-shelf foam to create the foam layers 122 and 126 having desired thickness(es). The upper patch layer, lower patch layer, foam layers, and feed/probe/slotted ground layers are attached to each other at step 716. This can include, for example, laminating the various layers together. In particular embodiments, these layers can be attached to each other using an FM300 film adhesive.

Formation of the stacked patch radiator is completed at step 718. This can include, for example, forming an environmental protection layer 136 over the layer 134, such as by painting the top of the layer 134. Any other or additional operations can also occur to complete the formation of the stacked patch radiator 100.

Although FIG. 7 illustrates one example of a method 700 for forming a low-profile stacked patch radiator with an integrated heating circuit, various changes may be made to FIG. 7. For example, while shown as a series of steps, various steps in FIG. 7 can overlap, occur in parallel, occur in a different order, or occur any number of times. Moreover, the illustrated example assumes that different portions of the stacked patch radiator 100 are formed separately and then attached together. Other implementations could also be used, such as those where structures are formed serially in a single stack.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a stacked patch radiator comprising (i) a lower patch and (ii) an upper patch located above and separated from the lower patch, the upper patch comprising first and second conductive patches that are separated from one another, wherein the upper and lower patches are stacked such that the first conductive patch of the upper patch is positioned between the lower patch and the second conductive patch of the upper patch; and a heating circuit integrated in the stacked patch radiator, at least a portion of the heating circuit positioned between the first and second conductive patches of the upper patch.

2. The apparatus of claim 1, wherein:

the stacked patch radiator is configured to radiate at a specified frequency band; and the stacked patch radiator has a thickness that is less than one tenth of wavelengths within the specified frequency band.

3. An apparatus comprising:

a stacked patch radiator comprising (i) a lower patch and (ii) an upper patch located above and separated from the lower patch, the upper patch comprising first and second conductive patches that are separated from one another; and a heating circuit integrated in the stacked patch radiator, at least a portion of the heating circuit positioned between the first and second conductive patches of the upper patch;

wherein the upper patch further comprises conductive vias electrically connecting the first and second conductive patches of the upper patch; and wherein the first and second conductive patches and the conductive vias of the upper patch form an isolation cage, the isolation cage configured to reduce a signal loss associated with a presence of at least the portion of the heating circuit between the first and second conductive patches.

4. The apparatus of claim 1, wherein:

a first portion of the heating circuit is positioned between the first and second conductive patches of the upper patch; and a second portion of the heating circuit is located around an aperture associated with the stacked patch radiator.

5. The apparatus of claim 1, wherein the heating circuit is configured to provide de-icing and anti-icing in the stacked patch radiator.

6. The apparatus of claim 1, wherein the heating circuit is configured to provide heating power uniformly over at least part of an aperture associated with the stacked patch radiator.

7. The apparatus of claim 1, wherein the stacked patch radiator further comprises:

a feed stripline configured to transmit signal energy; and a ground plane comprising a slot, the ground plane configured to allow the signal energy from the feed stripline to be coupled to the lower patch and the upper patch through the slot.

8. The apparatus of claim 1, wherein the lower patch comprises third and fourth conductive patches that are separated from one another.

9. A system comprising:

an antenna array comprising multiple stacked patch radiators and one or more heating circuits;

wherein each stacked patch radiator comprises (i) a lower patch and (ii) an upper patch located above and separated from the lower patch, the upper patch comprising first and second conductive patches that are separated from one another, wherein the upper and lower patches are stacked such that the first conductive patch of the upper patch is positioned between the lower patch and the second conductive patch of the upper patch; and wherein at least a portion of the one or more heating circuits is positioned between the first and second conductive patches of the upper patches in the stacked patch radiators.

10. The system of claim 9, wherein:

each stacked patch radiator is configured to radiate at a specified frequency band; and each stacked patch radiator has a thickness that is less than one tenth of wavelengths within the specified frequency band.

11. A system comprising:

an antenna array comprising multiple stacked patch radiators and one or more heating circuits;

wherein each stacked patch radiator comprises (i) a lower patch and (ii) an upper patch located above and separated from the lower patch, the upper patch comprising first and second conductive patches that are separated from one another;

wherein at least a portion of the one or more heating circuits is positioned between the first and second conductive patches of the upper patches in the stacked patch radiators; and wherein, in each stacked patch radiator:

the upper patch further comprises conductive vias electrically connecting the first and second conductive patches of the upper patch; and the first and second conductive patches and the conductive vias of the upper patch form an isolation cage, the isolation cage configured to reduce a signal loss associated with a presence of at least the portion of the one or more heating circuits positioned between the first and second conductive patches.

12. The system of claim 9, wherein the one or more heating circuits comprise:

portions positioned between the first and second conductive patches of the upper patches; and additional portions located around and between apertures associated with the stacked patch radiators.

13. The system of claim 9, wherein the one or more heating circuits are configured to provide de-icing and anti-icing in the stacked patch radiators.

14. The system of claim 9, wherein the one or more heating circuits are configured to provide heating power uniformly over at least part of apertures associated with the stacked patch radiators.

15. The system of claim 9, wherein each of the stacked patch radiators further comprises:

a feed stripline configured to transmit signal energy; and a ground plane comprising a slot, the ground plane configured to allow the signal energy from the feed stripline to be coupled to the lower patch and the upper patch through the slot.

16. A system comprising:

an antenna array comprising multiple stacked patch radiators and multiple heating circuits;

wherein each stacked patch radiator comprises (i) a lower patch and (ii) an upper patch located above and separated from the lower patch, the upper patch comprising first and second conductive patches that are separated from one another;

wherein at least a portion of the heating circuits is positioned between the first and second conductive patches of the upper patches in the stacked patch radiators;

wherein the stacked patch radiators are arranged in multiple pairs of stacked patch radiators;

wherein the antenna array comprises multiple heating circuits, each heating circuit is associated with one of the pairs; and wherein each heating circuit comprises:

a first portion positioned between the first and second conductive patches of a first of the upper patches in the associated pair;

a second portion positioned between the first and second conductive patches of a second of the upper patches in the associated pair; and a third portion located around and between apertures associated with the stacked patch radiators in the associated pair.

17. A method comprising:

forming a stacked patch radiator comprising a lower patch and an upper patch located at least partially over the lower patch, the upper patch comprising first and second conductive patches that are separated from one another; and during formation of the stacked patch radiator, integrating a heating circuit in the stacked patch radiator, at least a portion of the heating circuit positioned between the first and second conductive patches of the upper patch;

wherein the upper and lower patches are stacked such that the first conductive patch of the upper patch is positioned between the lower patch and the second conductive patch of the upper patch.

18. The method of claim 17, wherein:

the stacked patch radiator is configured to transmit at a specified wavelength; and the stacked patch radiator is formed having a thickness that is less than or equal to one tenth the specified wavelength.

19. A method comprising:

forming a stacked patch radiator comprising a lower patch and an upper patch located at least partially over the lower patch, the upper patch comprising first and second conductive patches that are separated from one another; and during formation of the stacked patch radiator, integrating a heating circuit in the stacked patch radiator, at least a portion of the heating circuit positioned between the first and second conductive patches of the upper patch;

wherein forming the stacked patch radiator comprises forming conductive vias configured to electrically connect the first and second conductive patches of the upper patch; and wherein the first and second conductive patches and the conductive vias of the upper patch form an isolation cage, the isolation cage configured to reduce a signal loss associated with a presence of at least the portion of the heating circuit between the first and second conductive patches.

20. The method of claim 17, wherein:

a first portion of the heating circuit is positioned between the first and second conductive patches of the upper patch; and a second portion of the heating circuit is located around an aperture associated with the stacked patch radiator.

21. The apparatus of claim 1, wherein:

the upper patch further comprises conductive vias electrically connecting the first and second conductive patches of the upper patch; and the first and second conductive patches and the conductive vias of the upper patch form an isolation cage, the isolation cage configured to reduce a signal loss associated with a presence of at least the portion of the heating circuit between the first and second conductive patches.

22. The apparatus of claim 1, wherein:

the stacked patch radiator comprises one of multiple stacked patch radiators in an antenna array;

the heating circuit comprises one of multiple heating circuits;

the stacked patch radiators are arranged in multiple pairs of stacked patch radiators;

each heating circuit is associated with one of the pairs; and each heating circuit comprises:

a first portion positioned between the first and second conductive patches of a first of the upper patches in the associated pair;

a second portion positioned between the first and second conductive patches of a second of the upper patches in the associated pair; and a third portion located around and between apertures associated with the stacked patch radiators in the associated pair.

* * * * *